US008330532B2

(12) United States Patent
Nikolov et al.

(10) Patent No.: US 8,330,532 B2
(45) Date of Patent: Dec. 11, 2012

(54) POWER EFFICIENT GENERATION OF BAND GAP REFERENCED SUPPLY RAIL, VOLTAGE AND CURRENT REFERENCES, AND METHOD FOR DYNAMIC CONTROL

(75) Inventors: Ludmil Nikolov, Chippenham (GB); Carlos Calisto, Swindon (GB)

(73) Assignee: Dialog Semiconductor GmbH, Kirchheim/Teck-Nabern (DE)

( * ) Notice: Subject to any disclaimer, the term of this patent is extended or adjusted under 35 U.S.C. 154(b) by 73 days.

(21) Appl. No.: 12/932,993

(22) Filed: Mar. 11, 2011

(65) Prior Publication Data

US 2012/0229202 A1 Sep. 13, 2012

(30) Foreign Application Priority Data

Mar. 7, 2011 (EP) ..... 11368006

(51) Int. Cl.
*G05F 1/10* (2006.01)

(52) U.S. Cl. ..... 327/540; 327/539; 323/280

(58) Field of Classification Search ..... 327/538, 327/540, 539, 530, 541–543; 323/280
See application file for complete search history.

(56) References Cited

U.S. PATENT DOCUMENTS 5,160,856 A 11/1992 Yamaguchi et al.
5,300,823 A * 4/1994 Ihara ..... 327/544
6,114,843 A * 9/2000 Olah ..... 323/280
6,326,837 B1 * 12/2001 Matano ..... 327/545
6,337,598 B1 * 1/2002 Ohno ..... 327/540
6,545,530 B1 * 4/2003 Jordan ..... 327/540
6,642,776 B1 * 11/2003 Micheloni et al. ..... 327/539
6,919,755 B2 * 7/2005 Egerer et al. ..... 327/530
6,930,539 B2 * 8/2005 Erckert ..... 327/540
7,053,592 B2 5/2006 Pihet et al.
(Continued)

FOREIGN PATENT DOCUMENTS

DE 10223772 12/2003
(Continued)

OTHER PUBLICATIONS

European Search Report—11368066.0-1239 Mail date Nov. 4, 2011.

*Primary Examiner* — Thomas J Hiltunen
(74) *Attorney, Agent, or Firm* — Saile Ackerman LLC; Stephen B. Ackerman

(57) ABSTRACT

Circuits and methods for power efficient generation of supply voltages and currents in an integrated circuit by reducing the power consumption of all core analog circuit blocks by a pulsed operation mode are disclosed. In a preferred embodiment of the invention the invention has been applied to a power management chip. Pulsed Mode of Operation of ALL core analog blocks—internal LDO/s, VREF an IBIAS generators, results in significantly reduced power consumption. New circuit realizations and control algorithms to improve the ON/OFF ratio of the Pulsed Mode Operation yield in better power efficiency. Innovative circuit implementation consisting of an additional Top Up Buffer Amplifier stage ensures a fast recharge of VREF output, thus allowing shorter ON times and respectively even better power efficiency. Bypassing a low bandwidth and slow to start LDO with a fast Bypass Comparator supplies a LDO rail in Pulsed Mode of operation. A Dynamic Control of the Commutating Components ensures least disturbance of the voltage potentials, thus allowing shorter ON times and respectively better power efficiency. The invention can also be applied to reference voltage and to bias current generator circuits.

21 Claims, 4 Drawing Sheets

U.S. PATENT DOCUMENTS

| | | | | |
|---|---|---|---|---|
| 7,205,829 | B2 * | 4/2007 | Herbert et al. | 327/540 |
| 7,285,943 | B2 * | 10/2007 | Migliavacca | 323/277 |
| 7,362,081 | B1 * | 4/2008 | Huang | 323/282 |
| 7,557,558 | B2 | 7/2009 | Barrow | |
| 7,567,063 | B1 | 7/2009 | Suzuki et al. | |
| 2004/0212421 | A1 | 10/2004 | Naka et al. | |
| 2009/0009150 | A1 | 1/2009 | Arnold | |
| 2010/0308781 | A1 | 12/2010 | Kao et al. | |
| 2011/0032027 | A1 * | 2/2011 | Dash et al. | 327/539 |

FOREIGN PATENT DOCUMENTS

| | | |
|---|---|---|
| JP | 2005050021 | 2/2005 |

* cited by examiner

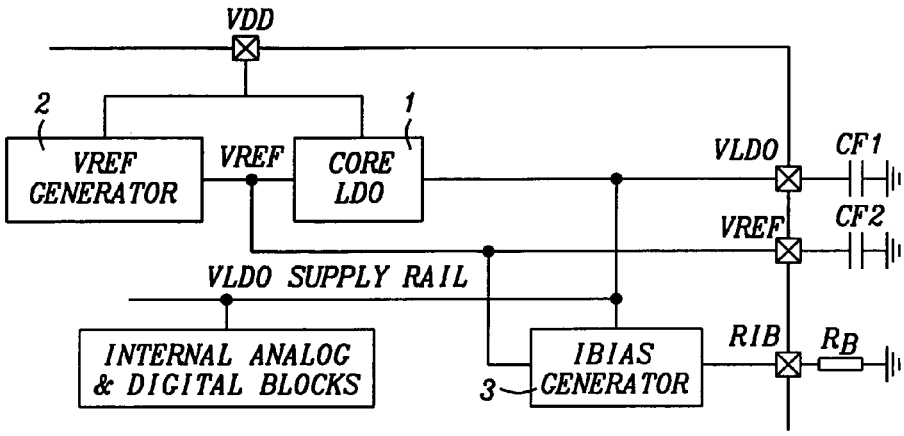
FIG. 1A – Prior Art
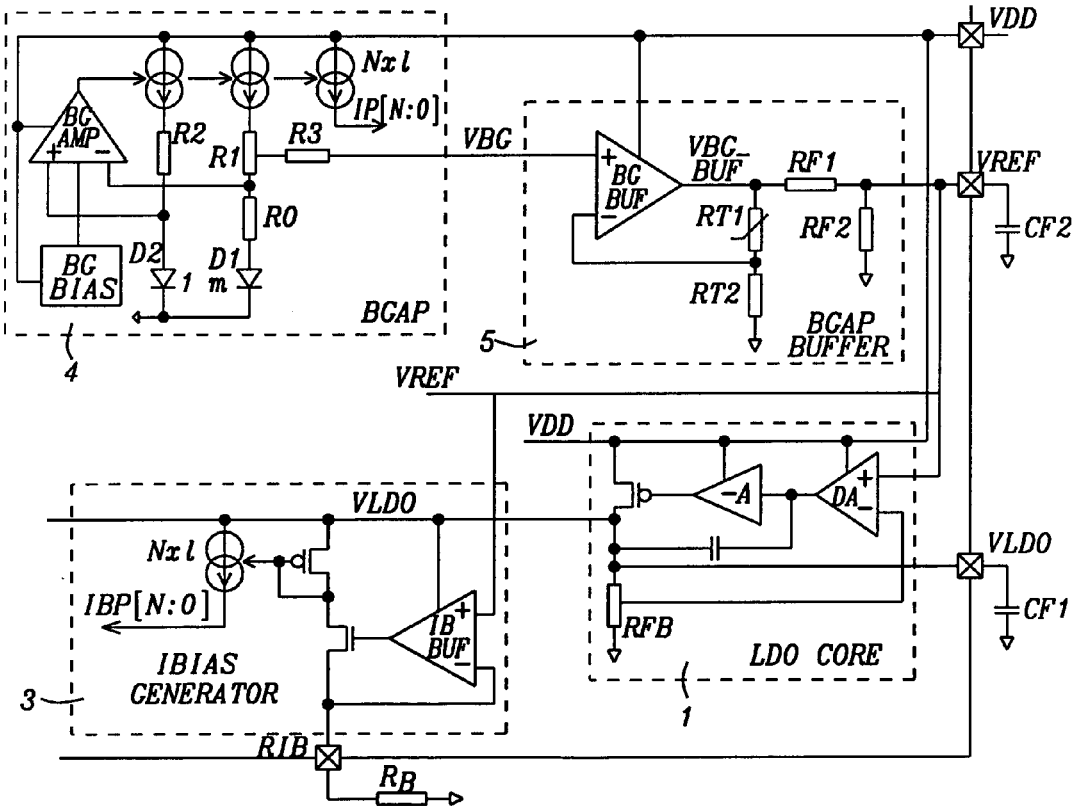
FIG. 1B – Prior Art

POWER EFFICIENT GENERATION OF BAND GAP REFERENCED SUPPLY RAIL, VOLTAGE AND CURRENT REFERENCES, AND METHOD FOR DYNAMIC CONTROL

BACKGROUND (1) Field of the Invention

This invention relates generally to integrated circuits and relates more specifically to generation of reference voltages and currents and their control for integrated circuits.

(2) Description of the Prior Art

Many Analogue, Mixed Signal and even Digital ICs require an internally generated regulated supply rail/s to power their blocks and circuits. The supply voltages for the various internal power domains are normally provided by integrated (on-chip) LDOs (Low Drop-Out Regulators).

Other blocks that are often required for the proper operation of many analogue and mixed-signal ICs are a reference voltage (VREF) Generator—usually a Band Gap based circuit providing an accurate, supply and temperature independent voltage reference, and a IBIAS Generator—providing appropriately scaled bias currents for all analog blocks, and accurate reference currents for ADCs, IDACs, Chargers, Current Comparators and other similar circuits.

The requirement to integrate these three mandatory blocks—internal LDO/s, VREF and IBIAS Generator is particularly relevant to e.g. PM (Power Management) ICs, which typically being the sole PM controller circuit in a system, can not rely on externally generated supply rails or references.

The current practice is to turn on these circuits during the initial power up of the IC and keep them active until the IC is powered down, thus permanently adding their standby current consumption to the overall consumption of the device. This power inefficient approach is particularly disadvantageous for ICs designed for battery operated applications.

The block diagram in FIG. 1A prior art shows a typical configuration of the three core analogue blocks—internal supply regulators such as core low-drop-out regulators (LDO) 1, VREF 2 and (BIAS 3 generators, which have to be integrated on many ICs to ensure their functionality and to guarantee their parametric performance. Also shown are the external passive components that are typically required for the proper operation of these blocks.

Being responsible for the generation of the internal supply voltages, voltage references and bias currents for all other blocks on the chip, these core circuits normally remain active and consume power for as long the IC is powered from the external VDD source. Most of the battery operated mobile devices (phones, MP3 players, GPS navigation, etc.) employ various low power modes (sleep, stand-by, hibernate, etc.) to preserve the battery energy and to maximize the operation time. As a result, the implementation of similar low power modes becomes mandatory also for the integrated circuits used in such applications. An IC in any power saving mode will generally have most (if not all) of the functional blocks powered down (zero current) or in stand-by mode (minimum current), leaving only the core analogue blocks active and ready at any time to quickly bring the chip back into active mode.

Often, when the device is operating in a power saving mode, the total power consumption is dominated by the consumption of the core analogue blocks. This fact highlights the importance of the task of minimizing the power consumption of these circuits. An obvious and commonly used approach is to use ultra-low current designs employing a variety of low voltage and low current architectures. This approach, though, has its own physical and process limitations, i.e. there are certain absolute minimums of the voltage and current levels below which the performance (accuracy, stability, speed, etc.) of the circuit starts being severely affected. In addition, this approach can often be very costly in terms of design time and/or silicon area.

FIG. 1B prior art illustrates the detailed implementation of commonly used circuit architecture for the core analogue blocks. It includes a classical band gap BGAP circuit 4 providing a temperature independent reference voltage and a BGAP BUFFER circuit 5 used to isolate the large external filtering capacitor $C_F$2, and to facilitate the accurate trimming of the VREF voltage. The internal LDO CORE regulator 1 uses the VREF as input voltage reference and generates the internal VLDO supply rail. The VLDO pin is not used as power supply output, but only for connecting the external decoupling capacitor $C_F$1. The BIAS block 3 is powered from the VLDO supply and uses the VREF reference and a precision external resistor $R_B$ to generate accurate bias current outputs.

It is a challenge for engineers designing integrated circuits to effectively reduce the power consumption of these core analog blocks.

There are known patents or patent publications dealing with supply sources for integrated circuits:

U.S. Patent Application 2009/0009150 to Arnold discloses an integrated electronic device for generating a reference voltage. The circuitry has a bias current generator for generating a first bias current, a diode element coupled to the bias current generator and fed by a second bias current derived from the first bias current for converting the second bias current into a reference voltage across the diode element, a supply voltage pre-regulator stage for regulating the supply voltage used for the bias current generator, and an output buffer coupled to the reference voltage for providing a low impedance output, wherein the reference voltage is coupled to the supply pre-regulator stage for biasing the supply pre-regulator stage by the reference voltage.

U.S. Pat. No. 7,557,558 to Barrow discloses an IC current reference including a reference voltage Vref, a current mirror, and a transistor connected between the mirror input and a first I/O pin and which is driven by Vref. A resistor external to the IC and having a resistance R1 is coupled to the first I/O pin such that it conducts a current Iref which is proportional to Vref/R1; use of a low TC/VC resistor enables Iref to be an accurate and stable reference current. The current mirror provides currents which are proportional to Iref, at least one of which is provided at a second I/O pin for use external to the IC. One primary application of the reference current is as part of a regulation circuit for a negative supply voltage channel, which can be implemented with the same number of external components and I/O pins as previous designs, while providing superior performance.

U.S. Pat. No. 5,160,856 to Yamaguchi et al. proposes a semiconductor integrated circuit for a CMOS microcomputer and others having an analog circuit, in which a gate voltage of a transistor for setting a bias current is generated by arranging a diode formed by two islands in a MOS structure and a transistor in series, so as to decrease also a temperature dependence characteristic of the analog circuit. Thereby, the fluctuation of the characteristic of the analog circuit can be restrained despite of fluctuation not only of a power-supply voltage but also of a temperature.

SUMMARY

A principal object of the present invention is to achieve a significant reduction of the power consumption of core analogue blocks of an integrated circuit without a reduction of biasing currents for the blocks.

Another principal object of the invention is to reduce of the ON time period in Pulsed Mode A further object of the invention is to introduce Pulsed Mode of Operation of all core analogue blocks.

A further object of the invention is to achieve new circuit realizations and control algorithms to improve the ON/OFF ratio of the Pulsed Mode Operation resulting in better power efficiency.

A further object of the invention is to develop an innovative circuit implementation consisting of an additional Top Up Buffer (TU_BUF) Amplifier stage to ensure the fast recharge of reference voltage VREF output, thus allowing shorter ON times and respectively better power efficiency Another object of the invention is to develop a new approach of bypassing the low bandwidth and slow to start LDO with a fast Bypass Comparator (BYP_COMP) that maintains the internal supply rail in Pulsed Mode of Operation.

Furthermore an object of the invention is to develop a detailed circuit implementation of the Commutating Components (Pulsed Mode Switches).

Moreover an object of the invention is to develop a New Method for Dynamic Control of the Commutating Components ensuring least disturbance of the voltage potentials, thus allowing shorter ON times and respectively better power efficiency.

In accordance with the objects of this invention a method for a power efficient generation of supply voltages and currents in an integrated circuit by reducing the power consumption of all core analog circuit blocks has been achieved. The method invented comprises, firstly, the following steps: (1) providing an integrated circuit comprising analog blocks generating one or more internal reference voltages, one or more internal supply voltages, and one or more biasing currents, a pulsed mode control logic block, and one or more external capacitors, (2) operating all analog blocks of the circuit in pulsed mode, and (3) reducing the ON-time of the analog blocks by achieving quick recharge of internal nodes and the external capacitors by a top-up buffer. Further the method disclosed comprises (4) minimizing the ON-time of the analog blocks by introducing dynamic control of commutating components ensuring least disturbances of the voltage potentials of the circuit, (5) bypassing low bandwidth blocks by fast bypass comparators, and (6) maintaining voltage levels in the circuit by charge holding capacitors during OFF periods of the pulsed mode.

In accordance with the objects of this invention a circuit for a power efficient generation of supply voltages and currents in an integrated circuit by reducing the power consumption of all core analog circuit blocks by a pulsed mode has been disclosed. The circuit invented comprises, firstly: a pulsed mode control block performing a dynamic control of a pulsed mode of operation reducing ON-time of all analog blocks of the circuit to an operational minimum, a band gap reference voltage generating block wherein its output is connected to a first terminal of a first capacitor and to an input of a band gap buffer block, said first capacitor having its second terminal connected to ground, and said band gap buffer block wherein its output is a VREF reference voltage. Furthermore the circuit comprises a Top-Up buffer amplifier and switch isolating the band gap buffer output from a VREF external capacitor during the OFF-time of the band gap buffer amplifier, and allowing a quick recharge and settling of VREF node during the ON-time, said VREF external capacitor, an external VLDO capacitor, and a LDO core block, wherein a BYP_COMPARATOR circuit is implemented to maintain a voltage level of an internal LDO supply rail. Moreover the circuit comprises said BYP_COMPARATOR circuit, comparing the VREF reference voltage with a voltage on a node of a LDO voltage divider string and dependent of the result of the comparison a driver transistor recharges the external LDO capacitor, said driver transistor enabled to recharge quickly said external LDO capacitor, and an BIAS generator, generating a bias current.

In accordance with the objects of this invention a circuit for a power efficient generation of supply voltages and currents in an integrated circuit by reducing the power consumption of all core analog circuit blocks by a pulsed mode has been disclosed. The circuit invented comprises, firstly: a pulsed mode control block performing a dynamic control of a pulsed mode of operation reducing ON-time of all analog blocks of the circuit to an operational minimum, a band gap reference voltage generating circuit, comprising a band gap bias current generating block, a band gap operational amplifier, wherein its output is controlling one or more current sources each providing current for a diode branch, a first switch, a second switch controlling a voltage across a second capacitor and an output bias current, wherein its output is connected to a first terminal of a first capacitor and to an input of a band gap buffer block, and wherein signals from said pulsed mode control block are starting the band gap reference voltage generating circuit, enabling the band gap current generating block, the operational amplifier, and controlling said first and second switch, said first capacitor having its second terminal connected to ground and said band gap buffer block, comprising a buffer amplifier, wherein the output of the band gap buffer block is a VREF reference voltage, and wherein the output of the band gap buffer block is connected to a Top-Up Buffer circuitry. Furthermore the circuit comprises said Top-Up circuitry comprising a buffer amplifier and third switch, isolating the BGAP buffer amplifier from a VREF capacitor during OFF-time of the pulsed mode allowing a quick recharge of VREF node during ON-time of the pulsed mode, and wherein signals from said pulsed mode control block enable the Top-Up buffer amplifier and control said third switch, said VREF capacitor deployed between said third switch and ground, an external LDO capacitor connected to a node of a LDO voltage divider string of a LDO circuit, a BYP_COMPARATOR circuit, comparing the VREF reference voltage with a voltage on said node of a LDO voltage divider string and, dependent on the result of the comparison, a driver transistor recharges the external LDO capacitor, wherein a signal from said pulsed mode control block enables the BYP_COMPARATOR circuit and disables said LDO circuit. Moreover the circuit comprises said driver transistor enabled to recharge quickly said external LDO capacitor, said LDO core block, wherein the BYP_COMPARATOR circuit is implemented to maintain a voltage level of an internal LDO supply rail and wherein its output is a VLDO voltage which is connected to a IBIAS generator, and said IBIAS generator, generating a bias current, comprising a buffer amplifier, a fourth switch controlling the output of the (BIAS generator, an IBIAS capacitor to maintain a voltage level at an output node during off-time of the pulsed mode, wherein signals from said pulsed mode control block enables said buffer amplifier and current bias generation and control said fourth switch.

BRIEF DESCRIPTION OF THE DRAWINGS

In the accompanying drawings forming a material part of this description, there is shown:

FIG. 1A prior art shows a block diagram in a typical configuration of three core analogue blocks—internal supply regulators such as core low-drop-out regulators.

FIG. 1B prior art illustrates a detailed implementation of commonly used circuit architecture for the core analogue blocks.

DESCRIPTION OF THE PREFERRED EMBODIMENTS

Methods and circuits for power efficient core analog blocks of integrated circuits (ICs), comprising reference voltage (VREF) generators, biasing current (IBIAS) generators, and internal supply DC/DC converters, are disclosed.

Preferred embodiments of the invention are presenting an approach characterized by simple to implement, area efficient and achieving significant power reduction with no adverse effects on the circuit performance.

Figure 2:
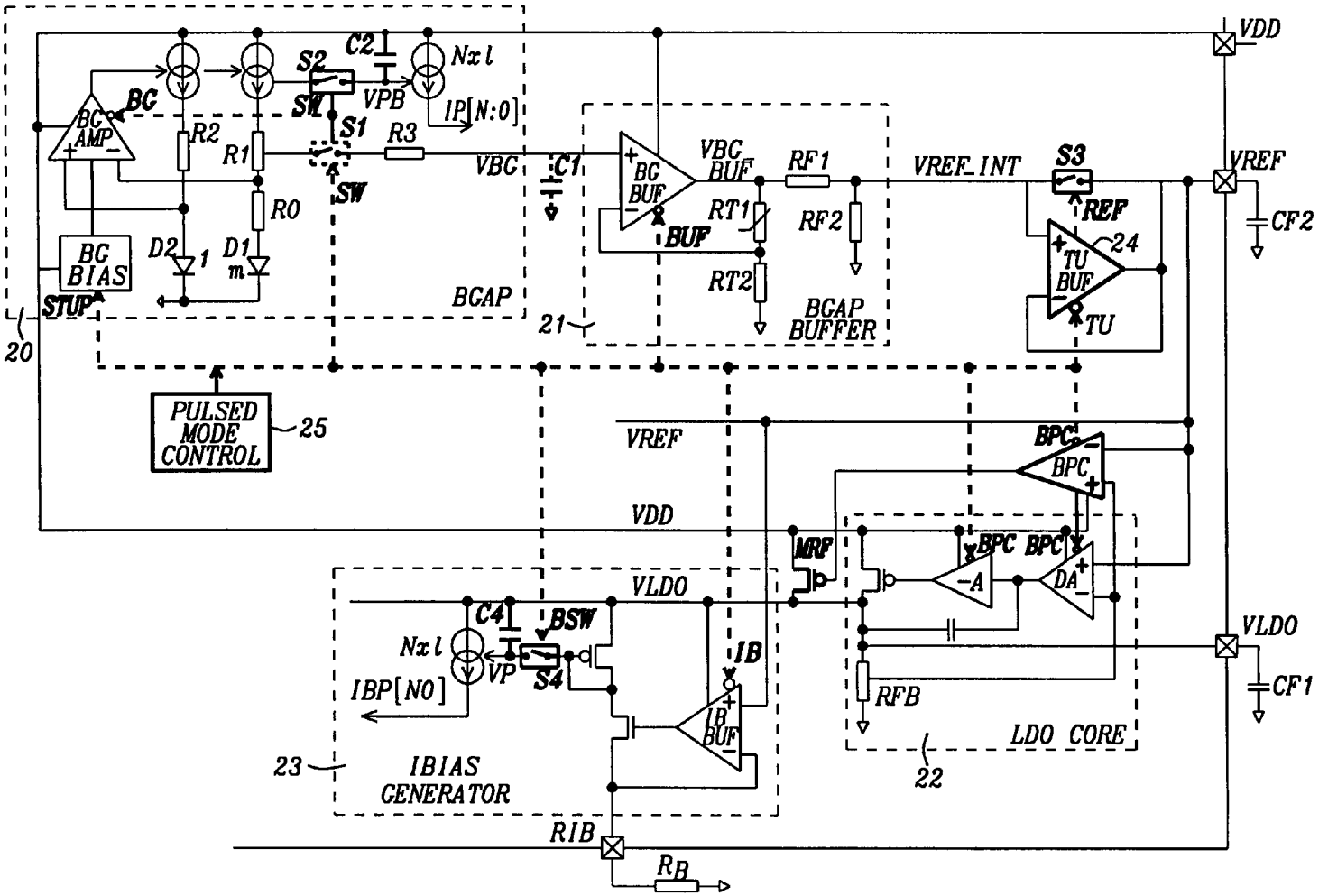
FIG. 2 shows a Pulsed Mode implementation of the present invention in regard of the same core analogue blocks as shown in FIGS. 1A-B prior art.

FIG. 2 shows a Pulsed Mode implementation of the present invention in regard of the same core analogue blocks as shown in FIGS. 1A-B prior art, namely a BGAP circuit 20, a BGAP BUFFER circuit 21, an internal LDO CORE regulator 22, a IBIAS block 23, and a pulsed mode control block 25. FIG. 2 shows a Pulsed Mode implementation invented of the same core analogue blocks. All additions and modifications compared to the prior art circuits shown in FIG. 1B are highlighted. Furthermore the circuit comprises a pulsed mode control block 25 performing a dynamic control of the Pulsed mode of operation.

Figure 3:
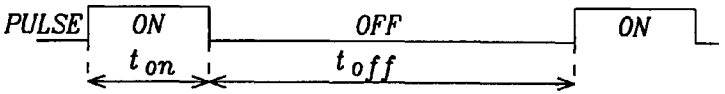
FIG. 3 illustrates the Pulsed Mode of operation based on the concept of Dynamic Control, i.e. turning on (enable) the core analogue blocks for a short ON Time period and keeping them off (disabled) for a significantly longer OFF Time period.

FIG. 3 illustrates the Pulsed Mode of operation based on the concept of Dynamic Control, i.e. turning on (enable) all core analogue blocks for a short ON Time period and keeping them off (disabled) for a significantly longer OFF Time period.

Turning to FIG. 3 the resultant average current consumption is given by:

$$I_{VDD} = \frac{I_{ON} \times t_{ON} + I_{OFF} \times t_{OFF}}{t_{ON} + t_{OFF}},$$

where $I_{ON}$ is the active state current and $I_{OFF}$ is the consumption in the OFF state. Considering that $I_{OFF}$ is minimal (almost zero, as most of the circuits are powered down), it is the ratio between the ON and the OFF times that determines the $I_{VDD}$ current. Obviously, shorter ON and longer OFF periods are desired, as the greater the $T_{OFF}/T_{ON}$ ratio is, the greater is the current saving.

Returning now to FIG. 2, during the OFF period all circuits (except for the BYP_COMP comparator) are disabled and the switches S1 to S4 are open, thus isolating the VBG, VREF, VPB and VP nodes from the currently powered down driving circuits.

The voltage levels are maintained by internal C1, C2 and C4 and external $C_F$1 and $C_F$2 charge holding capacitors, which in effect ensures the presence of the VREF voltage and the bias currents throughout the whole cycle. The duration of the OFF time is limited by the maximum tolerable VREF error, i.e. the voltage drop due to the capacitors being discharged by internal and/or external leakage currents and as such can not be infinitely extended. This fact highlights the real importance of circuit implementation with a minimum ON time duration.

During the ON time all the circuits are re-activated and switches S1, S2 and S4 are closed to re-connect the charge holding capacitors to the driving circuits. The ON time needs to be as short as possible, but still long enough to allow the complete re-charge and settling of the VBG, VREF, VPB and VP voltages. If this essential design requirement is violated the VREF accuracy will be affected by the cumulative effect of this error exhibited in the consecutive ON/OFF cycles.

A particular design challenge is the recharge of the VREF node. The high RC time constant associated with the low pass output filter, formed by large external $C_F$2 capacitor and the $R_F$1-$R_F$2 resistive divider, pushes the settling time far beyond the desired duration of the ON time period. A new technique implementing an additional Top-Up Buffer (TU_BUF) amplifier 24 is used to overcome this major problem. The S3 switch is forced to remain open during the ON time, thus isolating the BG_BUFF output from the large $C_F$2 capacitor and allowing the quick recharge and settling of the VBG_BUF and VREF_INT nodes to their accurate steady state levels.

The new TU_BUF unity gain amplifier has low output impedance that allows the fast recharge/top-up of the external VREF capacitor $C_F$2. The gain in the overall current reduction resulting from the shorter ON time significantly over-weights the added current consumption of the new TU_BUF amplifier. Properly designed, the amplifier offset is small enough and the resultant error is within the acceptable tolerance for the VREF reference voltage.

A similar problem poses the long start-up and settling time of the core LDO. Being typically a low bandwidth circuit, the LDO is not suited for the Pulsed Mode operation. Its inclusion in the scheme would require unacceptably long ON time period. For that reason, the core LDO is permanently disabled in Pulse Mode and a new BYP_COMP circuit is implemented to maintain the voltage level of the internal VLDO supply rail. As illustrated in FIG. 2, this comparator uses VREF as reference and gets its feedback signal from the existing feedback divider string in the LDO CORE. In combination with the additional $M_{BP}$ driver transistor it is able to quickly recharge the VLDO capacitor $C_F$1. The BYP_COMP has a built in hysteresis $\Delta_{dchg}$, which reduces the chance of VLDO oscillations caused by the continuous switching of $M_{BP}$ in the presence of significant current load on this supply rail.

Figure 4:
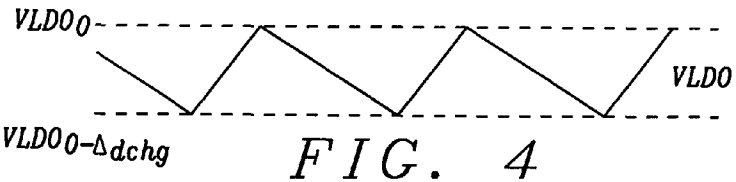
FIG. 4 illustrates a time chart of the LDO voltage VLDO.

FIG. 4 illustrates a time chart of the LDO voltage. VLDO. When the LDO voltage $VLDO=VLDO_0-\Delta_{dchg}$ ($VLDO_0$ being the target VLDO voltage level), the comparator toggles and recharges VLDO up to $VLDO_0$. The ripple on VLDO depends on the current being taken from this supply rail. Depending on the particular application, the expected current load and the acceptable ripple the BYP_COM circuit can be either permanently enabled in Pulsed Mode or just enabled for the ON time duration.

The implementation of the Pulsed Mode involves the switching of high impedance or heavily loaded nodes. To minimize errors, or inaccuracies, caused by the switching transients and to achieve best performance in terms of speed and settling time, the Pulsed Mode sequence is strictly controlled by a dedicated logic. It generates and ensures the correct timing of the control signals (STUP, BG, SW, BUF, TU, REF, BPC, IB and IBSW), mostly following the "make before break" principle. As a general rule, during an ON state to OFF state transition, the isolation switches are to be opened before the active circuit is switched off. Respectively during an OFF to ON transition, the active circuit is first turned on and its output is allowed to settle, before connecting it to the load by closing the correspondent switch.

The following paragraphs describe the Dynamic Control signals, their functionality and the timing sequence implemented to achieve maximum power reduction in the Pulsed Mode of operation.

STUP—Enable Control Signal for the BG BIAS block (enables Band gap start-up and bias circuits)

BG—Enable Control Signal for the BG AMP block (enables Band gap core and amplifier)

SW—ON Control for Switches S1 and S2 (closes switch)

BUF—Enable Control Signal for the BG BUF block (enables amplifier and feedback circuits)

TU—Enable Control Signal for the TU BUF block (enables unity gain buffer)

REF—ON Control for Switches S3 (closes switch)

BPC—Enable Control Signal for the BPC block (enables comparator circuit, disables LDO)

IB—Enable Control Signal for the IBIAS block (enables amplifier and current bias)

IBSW—ON Control for Switches S4 (closes switch)

Control Sequence During OFF->ON Transition

Figure 5:
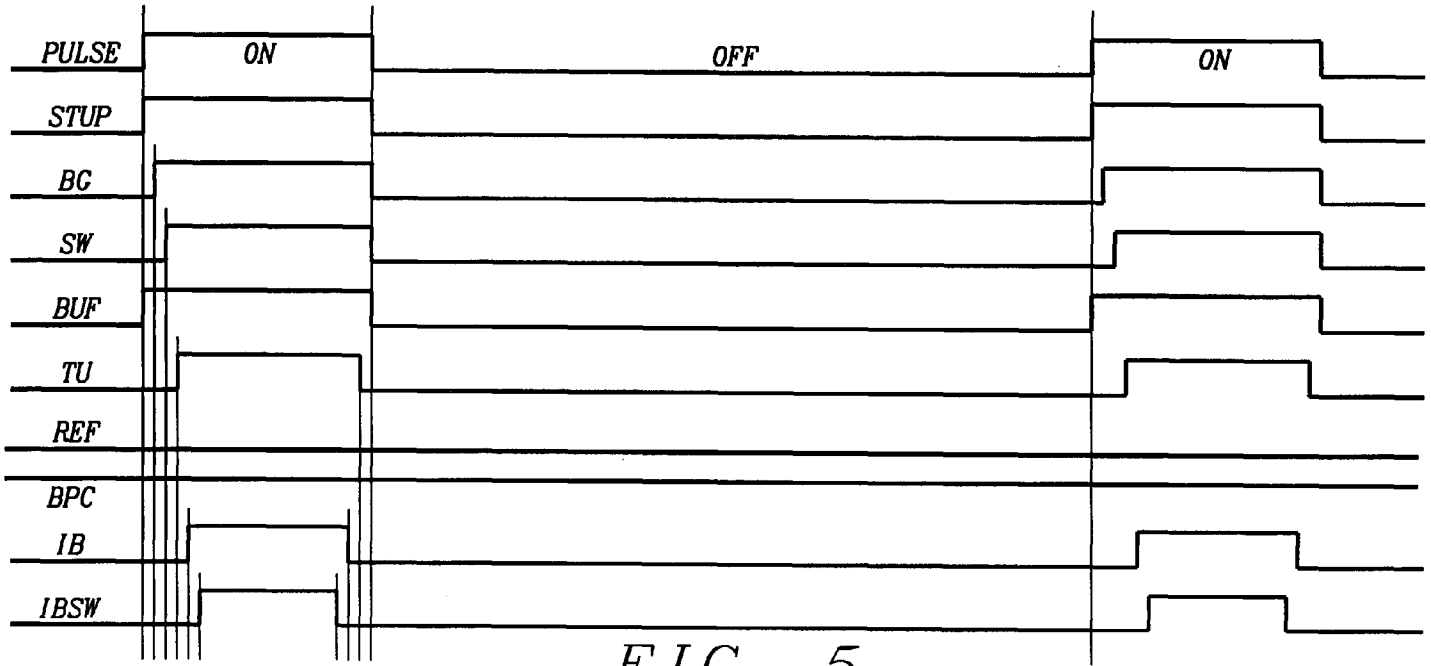
FIG. 5 depicts the exact timing sequence of the Dynamic Control signals.

The control signals STUP=1 and BUF=1 enable the Band gap start-up circuit and the BG_BUF buffer amplifier as shown in FIG. 5. Once the start-up current and voltage reference are settled, BG=1 enables the BG_AMP opamp and the D1, D2 diode branches generating the VBG voltage. When the currents and the voltages in the Band gap core have settled, SW=1 closes S2 and allows the voltage VPB to be re-charged to its nominal steady state level, which also sets the IP [N:0] current to its default value.

The IP [N:0] currents are mostly used as biasing currents for the various core analogue blocks, exp: BG_BUF and TU_BUF Amplifiers, the LDO CORE active circuits, the BYPASS comparator, etc. They can also be used as biasing currents for external (not core analogue blocks) blocks that might be required to be ON before the main IBIAS is up and capable of providing current references. A typical example would be an on-chip oscillator that needs to start immediately so it can generate a clock sequence that is required for the proper Pulsed Mode control signals generation, or generally to provide a clock for the digital core of the IC. These currents though can be rather inaccurate, i.e. have large tolerances.

The IBP [N:0] currents are the outputs of the main IBIAS current bias circuit that are used to bias all the rest analogue circuits in the IC. These are also accurate currents as their value is VREF/Rib, where VREF is the accurately trimmed reference voltage and Rib is an accurate (usually 1%) external resistor (not shown).

As the BG_BUF is already enabled, as soon as VBG settles, the Band gap buffer quickly re-charges VREF_INT node. Asserting TU=1 enables the Top-Up Buffer that re-charges VREF to the value defined by VREF_INT, i.e. the steady state VREF value.

Once VREF is re-charged, the assertion of IBIAS=1 enables the IBIAS generator circuit amplifier, setting the biasing current to its default value. After the current has settled, IBIAS_SW=1 closes S4, re-charges capacitor C4 and sets VP to its steady state level, which defines the correct currents in the mirror branches IBP [N:0].

Control Sequence During ON->OFF Transition

The assertion of IBIAS_SW=0 opens switch S4. The VP voltage is held by capacitor C4 and as a result the IBP [N:0] current outputs are not disturbed when the IBIAS amplifier is disabled by the IBIAS=0 control signal transition.

The TU=0 and BUF=0 control signals power down the Top-Up Buffer TU-BUF and the Band gap Buffer circuits respectively. During the OFF time the VREF voltage is held by the external capacitor Cr2.

Setting SW=0 opens switch S2. The VPB node is isolated from the Band gap core circuitry, the voltage is held by capacitor C2 and as a result the IP [N:0] current outputs are not affected when the Band Gap amplifier is disabled by the assertion of BG=0. STUP=0 then disables the Band gap start-up and bias circuit as they are no longer needed by the powered down amplifier.

In Pulsed Mode of operation the REF and BPC control signals remain static, respectively asserted as REF=0 and BPC=1. REF=0 keeps S3 open, thus isolating the large external capacitive load and the high impedance VREF_INT node, which allows the fast settling of the BG_BUF amplifier controlled loop. BPC=1 powers down the LDO and enables the bypass comparator BPC that maintains the VLDO rail during the Pulsed Mode operation.

The correct sequence and timing of the Dynamic Control signals is essential for achieving a minimum ON time period and respectively maximum reduction of the average supply current. FIG. 5 illustrates the exact timing sequence of the Dynamic Control signals.

It is especially the pulse sequences that matter. If the suggested sequence is disturbed, the circuits will still operate but not in the most efficient manner. The transitions from ON to OFF and vice versa are likely to be associated with undesired glitches on the important voltage nodes, which will impact the accuracy of the VREF voltage.

Circuit Variant

The Pulsed Mode concept can be realized with a slightly different circuit implementation, in which the switch S1 and the capacitor C1 are not present. The optional use of this commutating element and the associated capacitor depends on the particular electrical circuit of the BG_BUF amplifier and its electrical parameters (bandwidth, start-up and settling time, slew rate, etc.).

Moreover it should be noted that the invention could be applied to any reference voltage generating circuit, which output is not loaded by DC currents and can be hold for a short time by either internal or external capacitor. It can also be applied to many of the most commonly used (current mirror based) bias current generator circuits.

Figure 6:
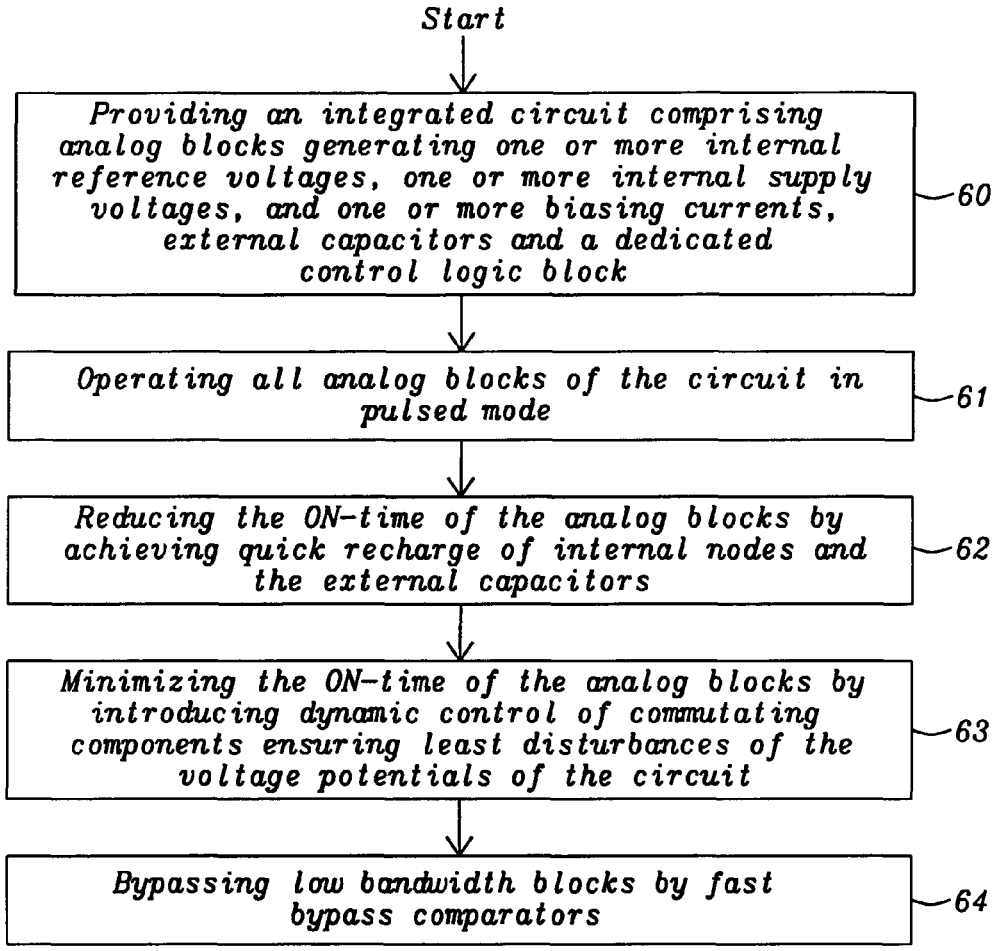
FIG. 6 illustrates a flowchart of a method invented for a power efficient generation of supply voltages and currents by reducing the power consumption of all core analog circuit blocks.

FIG. 6 illustrates a flowchart of a method invented for a power efficient generation of supply voltages and currents by reducing the power consumption of all core analog circuit blocks.

Step 60 of the method of FIG. 6 illustrates the provision of an integrated circuit comprising analog blocks generating one or more internal reference voltages, one or more internal supply voltages, and one or more biasing currents, a dedicated control logic block, and one or more external capacitors. Step 61 depicts operating all analog blocks of the circuit in pulsed mode. Step 62 illustrates reducing the ON-time of the analog blocks by achieving quick recharge of internal nodes and the external capacitors by a top-up buffer. The following step 63 shows minimizing the ON-time of the analog blocks by introducing dynamic control of commutating components ensuring least disturbances of the voltage potentials of the circuit. Step 64 illustrates bypassing low bandwidth blocks by fast bypass comparators and step 65 discloses maintaining voltage levels in the circuit by charge holding capacitors during OFF periods of the pulsed mode.

Moreover it should be noted that the invention could be applied to any reference voltage generating circuit, which output is not loaded by DC currents and can be hold for a short time by either internal or external capacitor. It can also be applied to many of the most commonly used (current mirror based) bias current generator circuits.

While the invention has been particularly shown and described with reference to the preferred embodiments thereof, it will be understood by those skilled in the art that various changes in form and details may be made without departing from the spirit and scope of the invention.

What is claimed is:

1. A method for a power efficient generation of supply voltages and currents in an integrated circuit by reducing the power consumption of all core analog circuit blocks, comprising the following steps:

(1) providing an integrated circuit comprising analog blocks generating one or more internal reference voltages, one or more internal supply voltages, and one or more biasing currents, a pulsed mode control logic block, and one or more external capacitors;

(2) operating all analog blocks of the circuit in pulsed mode;

(3) reducing the ON-time of the analog blocks by achieving quick recharge of internal nodes and the external capacitors by a top-up buffer;

(4) minimizing the ON-time of the analog blocks by introducing dynamic control of commutating components ensuring least disturbances of the voltage potentials of the circuit;

(5) bypassing low bandwidth blocks by fast bypass comparators; and (6) maintaining voltage levels in the circuit by charge holding capacitors during OFF periods of the pulsed mode.

2. The method of claim 1 wherein said pulsed mode control block controls a pulse mode sequence.

3. The method of claim 1 wherein ON-time is used to recharge nodes of the circuit to their nominal values.

4. The method of claim 3 wherein ON-time of an analog block having a high RC-time constant is significantly reduced by an additional top-up buffer amplifier, wherein its output is isolated from external capacitances during ON-time of the analog block by a switch.

5. The method of claim 4 wherein said analog block having a high RC time-constant is a band gap buffer.

6. The method of claim 1 wherein an additional comparator circuit is implemented to a LDO block to maintain voltage level of an internal LDO supply rail, wherein the comparator compares a reference voltage with a feedback voltage of the LDO and in combination with an additional driver transistor a LDO capacitor is quickly recharged.

7. The method of claim 6 wherein a hysteresis built in the comparator reduces chances of LDO oscillations.

8. The method of claim 1 wherein said pulsed mode control block ensures a correct sequence and timing of signals of the dynamic control to achieve a minimum ON-time and respectively maximum reduction of an average supply current.

9. The method of claim 1 wherein said integrated circuit is a power management circuit.

10. The method of claim 9 wherein said power management circuit comprises a band gap block, a band gap buffer block, a LDO regulator, a block generating biasing currents, a Top-Up buffer, a Bypass comparator, feedback circuits, and a pulsed mode control block.

11. The method of claim 10 wherein during an OFF to an ON transition of the pulsed mode an active circuit block is first turned ON and its output is allowed to settle before connecting it to a load by closing a correspondent switch.

12. The method of claim 10 wherein a pulsed mode control sequence during an OFF to ON transition of the pulse mode comprises a sequence of:

(1) enable the band gap block, the block generating biasing currents, the band gap buffer block, and the feedback circuits;

(2) enable an operational amplifier and diode branches of the band gap block generating a band gap output voltage;

(3) allowing voltage at node VPB to be recharged;

(4) enable Top-Up buffer;

(5) enable the block generating biasing currents; and (6) closing a switch S4 in order to re-charging a capacitor C4 of the block generating biasing currents and setting voltage at node VP in a block generating biasing currents to its steady state.

13. The method of claim 10 wherein a control sequence during an ON to OFF transition of the pulse mode comprises a sequence of:

(1) opening a switch S4 in order to avoid any disturbance when the block generating biasing currents is disabled;

(2) power down Top-up buffer and band gap buffer circuits;

(3) isolate VBP node; and (4) disable a band gap start-up and the block generating biasing currents.

14. The method of claim 1 wherein said integrated circuit is reference voltage generating circuit, which output is not loaded by DC currents and can be hold for a short time by one or more either internal or external capacitors.

15. The method of claim 1 wherein said integrated circuit is a current mirror based bias current generator circuit.

16. A circuit for a power efficient generation of supply voltages and currents in an integrated circuit by reducing the power consumption of all core analog circuit blocks by a pulsed mode, comprising:

a pulsed mode control block performing a dynamic control of a pulsed mode of operation reducing ON-time of all analog blocks of the circuit to an operational minimum;

a band gap reference voltage-generating block wherein its output is connected to a first terminal of a first capacitor and to an input of a band gap buffer block;

said first capacitor having its second terminal connected to ground;

said band gap buffer block wherein its output is a VREF reference voltage;

a Top-Up buffer amplifier and a switch isolating the band gap buffer output from a VREF external capacitor during the OFF-time of the band gap buffer amplifier, and allowing a quick recharge and settling of VREF node during ON-times;

an external VLDO capacitor;

a LDO core block, wherein a BYP_COMPARATOR circuit is implemented to maintain a voltage level of an internal LDO supply rail;

said BYP_COMPARATOR circuit, comparing the VREF reference voltage with a voltage on a node of a LDO voltage divider string and dependent of the result of the comparison a driver transistor recharges the external LDO capacitor;

said driver transistor enabled to recharge quickly said external LDO capacitor; and an BIAS generator, generating bias currents.

17. The circuit of claim 16 wherein said BYP_COMPARATOR has a built-in hysteresis to reduce a chance of oscillations.

18. The circuit of claim 16 wherein said pulse mode control block generates signals comprising:

STUP—enables band gap start-up and bias circuits;

BG—enables band gap core and amplifier;

SW—ON Control for switches of the band gap generator

BUF—enables amplifier and feedback circuits of the band gap buffer;

TU—enables Top-Up buffer amplifier;

REF—isolating the Top-Up buffer amplifier from external VREF capacitor; during ON-time;

BPC—enables BYP-comparator circuit, disables LDO;

IB—enables amplifier and current bias of the IBIAS block; and

IBSW—closes switch enabling bias current output of IBIAS block.

19. A circuit for a power efficient generation of supply voltages and currents in an integrated circuit by reducing the power consumption of all core analog circuit blocks by a pulsed mode, comprising:

a pulsed mode control block control block performing a dynamic control of a pulsed mode of operation reducing ON-time of all analog blocks of the circuit to an operational minimum;

a band gap reference voltage generating circuit, comprising a band gap bias current generating block, a band gap operational amplifier, wherein an output of the band gap operational amplifier is controlling one or more current sources each providing current for a diode branch, a first switch, a second switch controlling a voltage across a second capacitor and an output bias current, wherein an output of the second switch is connected to a first terminal of a first capacitor and to an input of a band gap buffer block, and wherein signals from said pulsed mode control block enable the band gap reference voltage generating circuit, enabling the band gap current generating block, the operational amplifier, and controlling said first and second switch;

said first capacitor having its second terminal connected to ground;

said band gap buffer block, comprising a buffer amplifier, wherein the output of the band gap buffer block is a VREF_INT reference voltage, and wherein the output of the band gap buffer block is connected to a Top-Up Buffer circuitry;

said Top-Up circuitry comprising a buffer amplifier and a third switch, isolating the Top-Up buffer amplifier from a VREF capacitor during OFF-time of the pulsed mode allowing a quick recharge of VREF node during ON-time of the pulsed mode, and wherein signals from said pulsed mode control block enable the Top-Up buffer amplifier and control said third switch;

said VREF capacitor deployed between said third switch and ground;

an external LDO capacitor connected to a node of a LDO voltage divider string of a LDO circuit;

a BYP_COMPARATOR circuit, comparing the VREF reference voltage with a voltage on said node of a LDO voltage divider string and, dependent on the result of the comparison, a driver transistor recharges the external LDO capacitor, wherein a signal from said pulsed mode control block enables the BYP_COMPARATOR circuit and disables said LDO circuit;

said driver transistor enabled to recharge quickly said external LDO capacitor;

wherein the BYP_COMPARATOR circuit is implemented to maintain a voltage level of an internal LDO supply rail and wherein its output is a VLDO voltage which is connected to an IBIAS generator; and said IBIAS generator, generating bias currents, comprising a buffer amplifier, a fourth switch controlling the output of the IBIAS generator, an IBIAS capacitor to maintain a voltage level at an output node during off-time of the pulsed mode, wherein signals from said pulsed mode control block enables said buffer amplifier and current bias generation and control said fourth switch.

20. The circuit of claim 19 wherein said first switch and said first capacitor are omitted.

21. The circuit of claim 19 wherein said pulse mode control block generates signals comprising:

STUP—enables band gap start-up and bias circuits;

BG—enables band gap core and amplifier;

SW—ON Control for switches of the band gap generator

BUF—enables amplifier and feedback circuits of the band gap buffer;

TU—enables Top-Up buffer amplifier;

REF—isolating the Top-Up buffer amplifier from external VREF capacitor; during ON-time;

BPC—enables BYP-comparator circuit, disables LDO;

IB—enables amplifier and current bias of the BIAS block; and

IBSW—closes switch enabling bias current output of IBIAS block.

* * * * *